US006565362B2

(12) United States Patent
Hayashi

(10) Patent No.: US 6,565,362 B2
(45) **Date of Patent: *May 20, 2003**

(54) ELECTRICALLY EQUIPPED PART FOR AUTOMOBILE, AUTOMOTIVE INTERIOR UNIT AND ASSEMBLING METHOD THEREOF

(75) Inventor: Hiroyuki Hayashi, Nagoya (JP)

(73) Assignees: Autonetworks Technologies, Ltd., Nagoya (JP); Sumitomo Wiring System, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/163,495

(22) Filed: Jun. 7, 2002

(65) Prior Publication Data

US 2002/0151214 A1 Oct. 17, 2002

Related U.S. Application Data

(62) Division of application No. 09/666,895, filed on Sep. 20, 2000, now Pat. No. 6,447,301.

(30) Foreign Application Priority Data

Sep. 24, 1999 (JP) ..... 11-270416
Sep. 24, 1999 (JP) ..... 11-270417

(51) Int. Cl.[7] ..... H01R 33/00
(52) U.S. Cl. ..... 439/34; 439/36; 439/553
(58) Field of Search ..... 439/564, 34, 36, 439/404, 409, 419, 551, 558, 926, 658, 565, 562, 563, 544, 553; 248/27.3, 27.1, 68.1; 362/490, 391; 296/214, 39.1, 146.7

(56) References Cited

U.S. PATENT DOCUMENTS

| | | | | |
|---|---|---|---|---|
| 4,500,746 A | | 2/1985 | Meehan | |
| 5,484,186 A | | 1/1996 | Van Order et al. | |
| 5,531,613 A | | 7/1996 | Takano et al. | |
| 5,795,179 A | * | 8/1998 | Lin | 439/419 |
| 5,823,816 A | * | 10/1998 | Uchida et al. | 439/36 |
| 5,848,902 A | | 12/1998 | Yamaguchi et al. | |
| 5,890,924 A | | 4/1999 | Endo et al. | |
| 6,039,579 A | * | 3/2000 | Paul et al. | 439/558 |
| 6,056,423 A | * | 5/2000 | Takano et al. | 362/490 |
| 6,422,889 B2 | * | 7/2002 | Hayashi | 439/342 |
| 6,447,301 B1 | * | 9/2002 | Hayashi | 439/34 |

FOREIGN PATENT DOCUMENTS

DE 198 04 586 A1 8/1998

* cited by examiner

*Primary Examiner*—Renee Luebke
*Assistant Examiner*—Felix O. Figueroa
(74) *Attorney, Agent, or Firm*—Oliff & Berridge, PLC

(57) ABSTRACT

An automotive interior unit having an interior member with an opening and fixed to the frame of an automobile. An electrically equipped part holding portion provided on a non-room side of the interior member and in the vicinity of the opening. An electric wire holding portion provided on the non-room side of the interior member and in the vicinity of the electrically equipped part holding portion. An electrically equipped part held in the electrically equipped part holding portion and exposing partially from the opening to a room side of the interior member and having an electric wire connecting portion connected to wires held in the electric wire holding portion.

7 Claims, 8 Drawing Sheets

ELECTRICALLY EQUIPPED PART FOR AUTOMOBILE, AUTOMOTIVE INTERIOR UNIT AND ASSEMBLING METHOD THEREOF

This is a Division of application Ser. No. 09/666,895 filed Sep. 20, 2000 now U.S. Pat. No. 6,447,301. The entire disclosure of the prior application(s) is hereby incorporated by reference herein in its entirety.

BACKGROUND OF THE INVENTION

The present invention relates to the installing structure of an electrically equipped part provided for an automotive interior member and the structure in which a wire harness is connected to the electrically equipped part.

As already known, electrically equipped parts such as a room lamp, a map lamp, and the like are installed in a room ceiling of an automobile. Further, electrically equipped parts such as a switch of a power window, a foot lamp, and the like are installed in a door trim.

A conventional example of the installing structure of the interior member and the electrically equipped part will be described. As shown in FIG. 5, a wire harness 10 is previously laid on the inside of a car body (not shown) that has been assembled by welding and painted; a leading end portion 11 of the wire harness 10 and a connector 12 are caused to pass through a room side (outside) of an interior member from a body side thereof (non-room side: inside) so as to pass through an opening 21 that is formed in the interior member (lining) 20 and used in order to attach the electrically equipped part thereto; and the interior member is fixed to a frame of the car body in this state. Further, after the connector 11 has been connected to the electrically equipped part 30, a portion 11 of the wire harness 10 that protrudes on a surface side of the interior member is forced between the interior member 20 and the car body, the electrically equipped part 30 is fitted into the opening 21 of the interior member 20, and finally, the electrically equipped part is fixed to the frame of the car body with a screw 22 and the like.

The above conventional interior member 20 and electrically equipped part 30 have been installed on the assumption that the work is performed in a main line of automobile assembly in an automaker. Therefore, a worker enters a narrow car room to perform the work, so that there was a problem that the work efficiency is very bad.

Recently, in order to reduce a period and cost that are necessary for automobile development, reduce cost of automobile parts, and simplify an assembly process; modularization of the automobile has been promoted. The modularization of the automobile means that though development, production, examination, delivery have been conventionally performed for each single part, they are performed in a unit (module) of the related plural parts, and that their steps are outsourced in a parts maker.

In the modularized assembling process of the automobile, the modular assembling work and the modular installing work into the car body are respectively performed in the separate lines. Therefore, the conventional installing structure of the interior member and the electrically equipped part cannot be followed as it is, that is, a new structure is required.

Further, the present invention relates to the installing structure of an electrically equipped part provided for an automotive interior member and the structure in which a wire harness is connected to the electrically equipped part.

As already known, electrically equipped parts such as a room lamp, a map lamp, and the like are installed in a room ceiling of an automobile. Further, electrically equipped parts such as a switch of a power window, a foot lamp, and the like are installed in a door trim.

A conventional example of the installing structure of the interior member and the electrically equipped part will be described. As shown in FIG. 5, a wire harness 10 is previously laid on the inside of a car body (not shown) that has been assembled by welding and painted; a leading end portion 11 of the wire harness 10 and a connector 12 are caused to pass through a room side (outside) of an interior member from a body side thereof (inside) so as to pass through an opening 21 that is formed in the interior member (lining) 20 and used in order to attach the electrically equipped part thereto; and the interior member is fixed to a frame of the car body in this state. Further, after the connector 11 has been connected to the electrically equipped part 30, a portion 11 of the wire harness 10 that protrudes on a surface side of the interior member is forced between the interior member 20 and the car body, the electrically equipped part 30 is fitted into the opening 21 of the interior member 20, and finally, the electrically equipped part is fixed to the frame of the car body with a screw 22 and the like.

The above conventional interior member 20 and electrically equipped part 30 have been installed on the assumption that the work is performed in a main line of automobile assembly in an automaker. Therefore, a worker enters a narrow car room to perform the work, so that there was a problem that the work efficiency is very bad.

Recently, in order to reduce a period and cost that are necessary for automobile development, reduce cost of automobile parts, and simplify an assembly process; modularization of the automobile has been promoted. The modularization of the automobile means that though development, production, examination, delivery have been conventionally performed for each single part, they are performed in a unit (module) of the related plural parts, and that their steps are outsourced in a parts maker.

In the modularized assembling process of the automobile, the modular assembling work and the modular installing work into the car body are respectively performed in the separate lines. Therefore, the conventional installing structure of the interior member and the electrically equipped part cannot be followed as it is, that is, a new structure is required.

SUMMARY OF THE INVENTION

The invention has been made in order to solve the problem of the above conventional example, and its object is to provide an electrically equipped part, an automotive interior unit and its assembling method that are suitable for modularization of the automobile.

In order to achieve the above object, an electrically equipped part for automobile according to the invention comprises a base portion attached to an opening formed in an automotive interior member from a room side; an electric wire connecting portion, which is provided for the base portion so as to protrude from the opening to a non-room side of the interior member in a state where the base portion is fitted in the opening, and which can be connected to electric wires laid on the non-room side of the interior member; and a function portion, which is provided for the base portion, connected to the electric wire connecting portion through a conductor, and performs the predetermined function.

In the above structure, it is preferable that the electric wire connecting portion is connected to a halfway portion of the electric wire.

Further, it is preferable that the electric wire laid on the non-room side of the interior member is an insulated coating wire, and that the electric wire connecting portion is provided so as to substantially intersect in the arrangement direction of the electric wires, and includes a contact member that breaks the insulated coating of the electric wire and comes into contact with a conductive portion of the electric wire.

Further, it is preferable that the electric wire connecting portion has lock mechanism that presses the electric wire against the contact member side and keeps the contact state between the contact member and the conductor.

Further, it is preferable that a first contact member is attached to the electric wire laid on the non-room side of the interior member, and a second contact member connected to the first contact member is attached to the electric wire connecting section.

Further, it is preferable that the electric wire connecting portion has lock mechanism that presses the first contact member against the second contact member side and keeps the contact state between the first contact member and the second contact member.

Further, in the above each constitution, it is preferable that a fitting portion fitted in the interior member is provided for the base portion.

Further, an automotive interior unit of the invention comprises an interior member that has an opening for attaching an electrically equipped part thereto and is fixed to a frame of an automobile; and an electrically equipped part of which at least a part is fitted in the opening from a room side, and which includes an electric wire connecting portion that can be electrically connected to electric wires laid on a non-room side of the interior member so as to cross the opening.

In the above constitution, it is preferable that the electric wire laid on the non-room side of the interior member is an insulated coating wire, and that the electric wire connecting portion is provided so as to substantially intersect in the arrangement direction of the electric wires, and includes a contact member that breaks the insulated coating of the electric wire and comes into contact with a conductive portion of the electric wire.

Further, it is preferable that the electric wire connecting portion has lock mechanism that presses the electric wire against the contact member side and keeps the contact state between the contact member and the conductor.

Further, it is preferable that a first contact member is attached to the electric wire laid on the non-room side of the interior member, and a second contact member connected to the first contact member is attached to the electric wire connecting section.

Further, it is preferable that the electric wire connecting portion has lock mechanism that presses the first contact member against the second contact member side and keeps the contact state between the first contact member and the second contact member.

On the other hand, an assembling method of an automotive interior unit according to the invention is characterized in that electric wires are laid on an interior member that has an opening in which an electrically equipped part fitted and that is fixed to a frame of an automobile, so as to cross the opening on a non-room side of the interior member; that a portion including at least an electric wire connecting portion of the electrically equipped part is inserted into the opening from the room side; and that the electric wire connecting portion is electrically connected to the portion of the electric wire crossing the opening.

Further, another assembling method of an automotive interior unit according to the invention is characterized in that in relation to an interior member that has an opening in which an electrically equipped part fitted and that is fixed to a frame of an automobile, a portion including at least an electric wire connecting portion of the electrically equipped part is inserted into the opening from a room side of the interior member; and that electric wires are laid on a non-room side so as to electrically connect to the electric wire connecting portion.

Further, in order to achieve the above object, an electrically equipped part for automobile according to the invention comprises an electrically equipped part body having a base portion that is attached in the vicinity of an opening formed in an automotive interior member from a non-room side in such a manner that a part thereof is exposed from the opening to a room side, an electric wire connecting portion, which is provided for the base portion and can be connected to electric wires laid on the non-room side of the interior member, and a function portion, which is provided for the base portion, connected to the electric wire connecting portion through a conductor, and performs the predetermined function; and an electrically equipped part holding member, which is formed separately from the base portion in order to fit and hold the base portion in the interior member, attached in the vicinity of the opening of the interior member, and has an electric wire holding portion for laying and holding the electric wire. Further, the electrically equipped part body is held in the electrically equipped part holding member thereby to connect the electric wire connecting portion to the electric wire held in the electric wire holding portion.

In the above constitution, it is preferable that the electric wire connecting portion is connected to a halfway portion of the electric wire.

Further, it is preferable that the electric wire is an insulated coating wire; and that the electric wire connecting portion is provided so as to substantially intersect in the arrangement direction of the electric wires held in the electric wire holding portion, and includes a contact member that breaks the insulated coating of the electric wire and comes into contact with a conductive portion of the electric wire.

Further, it is preferable that a first contact member is attached to a portion of the electric wire connected to the electrically equipped part, and that a second contact member connected to the first contact member is attached to the electric wire connecting section.

Further, an automotive interior unit of the invention comprises an interior member that has an opening and is fixed to a frame of an automobile; an electrically equipped part holding portion that is provided on a non-room side of the interior member and in the vicinity of the opening; an electric wire holding portion that is provided on the non-room side of the interior member and in the vicinity of said electrically equipped part holding portion; an electrically equipped part, which is held in the electrically equipped part holding portion so as to protrude partially from the opening to the room side, and which has an electric wire connecting portion connected electrically to electric wires held in the electric wire holding portion in the holding state.

In the above constitution, it is preferable that the electric wire is an insulated coating wire, and that the electric wire connecting portion is provided so as to substantially intersect in the arrangement direction of the electric wires, and includes a contact member that breaks the insulated coating of the electric wire and comes into contact with a conductive portion of the electric wire.

Further, it is preferable that the electrically equipped part is fitted and held in the electrically equipped part holding portion, whereby the electrically equipped part holding portion functions as lock mechanism that presses said contact portion against the electric wire side and keeps the contact state between the contact member and the conductor.

Further, it is preferable that a first contact member is attached to a portion of the electric wire connected to the electrically quipped part, and a second contact member connected to the first contact member is attached to the electric wire connecting portion.

Further, it is preferable that the electrically equipped part is fitted and held in the electrically equipped part holding portion, whereby the electrically equipped part holding portion functions as lock mechanism that presses the first contact member against the second contact member side and keeps the contact state between the first contact member and the second contact member.

Further, it is preferable that the electrically equipped part holding portion is an electrically equipped part holding member that is formed separately from the base portion and attached in the vicinity of the opening of the interior member, and that the electric wire holding portion is provided for this electrically equipped part holding member.

Further, it is preferable that the electrically equipped part holding portion and the electric wire holding portion are formed in the vicinity of the opening integrally with the interior member.

On the other hand, according to an assembling method of an automotive interior unit of the invention, in relation to an interior member that has an opening in which an electrically equipped part is inserted and an electrically equipped part holding portion provided in the vicinity of the opening, and that is fixed to a frame of an automobile; electric wires are laid on a non-room side of the interior member and in the vicinity of the electrically equipped part holding portion, and the electrically equipped part is fitted in the electrically equipped part holding member from the non-room side, thereby to electrically connect an electrical wire connecting portion of the electrically equipped part to the electric wires.

DETAILED DESCRIPTION OF THE PREFEERRED EMBODIMENTS (First Embodiment)

Figure 1:
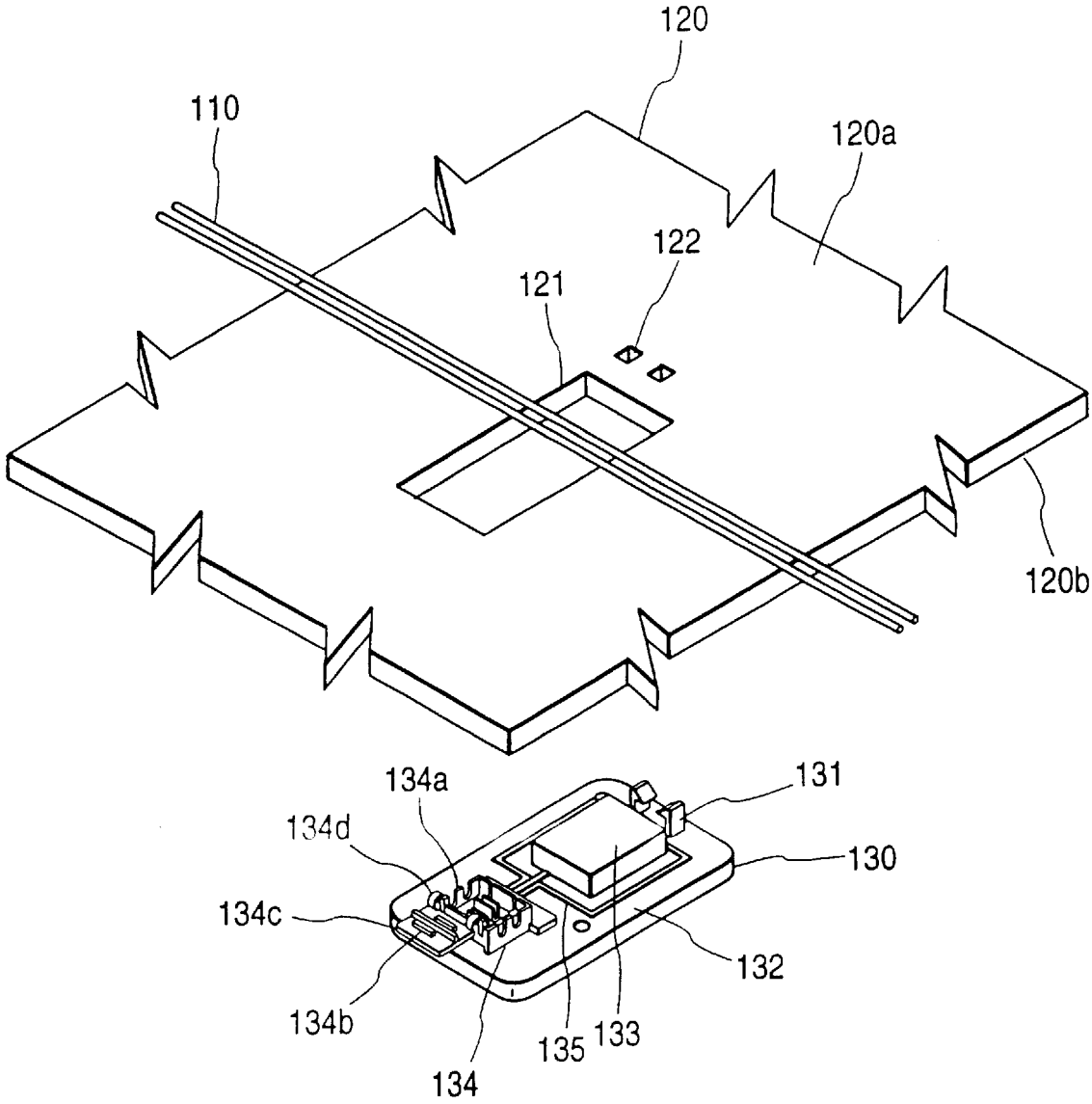
FIG. 1 is a diagram showing the constitution of one embodiment of an automotive interior unit of the invention.

First embodiment of an electrically equipped part for automobile, an automotive interior unit, and its assembling method according to the invention will be described. FIG. 1 shows the structure of an electrically equipped part for automobile and an automotive interior unit using its part in this embodiment. As one example of the interior unit, an interior unit for a car room ceiling to which an electrically equipped part such as a room lamp, a map lamp, and the like is attached will be described.

In an interior member 120, there are provided an opening 121 into which a part of an electrically equipped part 130 such as a room lamp, a map lamp, and the like is inserted; and a fitting hole 122 in which a pawl 131 provided for the electrically equipped part 130 is fitted and which temporarily fixes the electrically equipped part 130. Further, on a non-room side (inside) 120*a* of the interior member 120, electric wires 110 are previously laid so as to cross the opening 121. The electric wire 110 may be exclusive for only the electrically equipped part 130 in order to transmit the electric power and the predetermined signal, or it may be a bus line to which a plurality of the electrically equipped parts are connected in parallel. In case of the latter, the electrically equipped part 130 is connected to the halfway portion of the electric wire 110.

The electrically equipped part 130 comprises the above pawl 131, a flange portion (base portion) 132 that comes into contact with the interior member 120 from a room side 120*b;* a function portion 133 such as a light bulb, a switch, and the like; an electric wire connecting portion 134 electrically connected to the electric wires 110; and a conductor 135 connecting the function portion 133 and the electric wire connecting portion 134 to each other. In this embodiment, the function portion 133 and the electric wire connecting portion 134 are inserted into the opening 121 of the interior member 120 and they protrude on the non-room side of the interior member 120.

The electric wire connecting portion 134 comprises a contact housing portion 134 for housing and holding a contact member (pressure-welding terminal) 136 formed, for example, in the shape as shown in FIG. 2; a cover 134*b* that serves as lock mechanism for holding the contact state between the contact member 136 and the electric wires 110 by fitting in the contact housing portion 134*a;* a projection 134*c* that is provided for the cover 134*b* and presses the electric wires 110 against the contact member 136 side when the cover 134*b* is closed; and a hinge 134*d* for linking the contact housing portion 134*a* to the cover 134*b*.

Figure 2A:
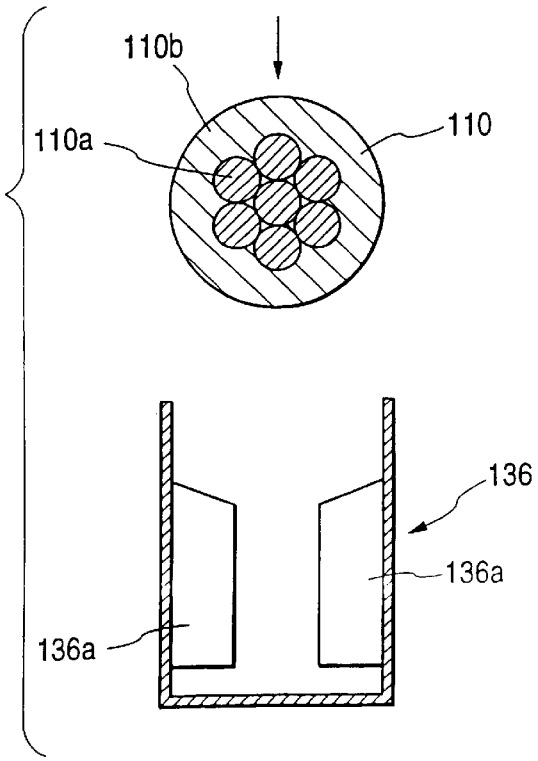
FIGS. 2A and 2B are diagrams showing a shape of a contact member in the above embodiment and showing a step in which an electric wire is forced into the contact member.
Figure 2B:
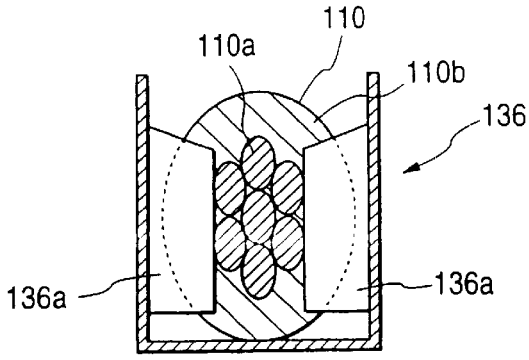

FIG. 2A shows a state before the electric wires 110 are forced into the contact member 136, and FIG. 2B shows a state after they has been forced. As shown in FIG. 2, the contact member 136 has plural sets (for example, two sets) of pressure welding blades 136*a* that protrude in the direction substantially orthogonal to the longitudinal direction of the electric wire 110 so as to be opposed to each other. Further, as the electric wire 110, an insulated coating electric wire coated with the insulating resin is used. When the electric wire 110 is forced into the contact member 136 by the projection 134*c,* the insulated coating 110 on the surface of the electric wire is broken by the pressure-welding blades 136*a,* and simultaneously, a core wire (conductor) 110*a* is held between the pressures welding blades 136*a*. Hereby, the electric wire 110 is electrically connected to the contact member 136. Further, since the contact member 136 is connected through the conductor 135 to the function portion 133, the function portion 133 is electrically connected to the electric wire 110.

Figure 3A:
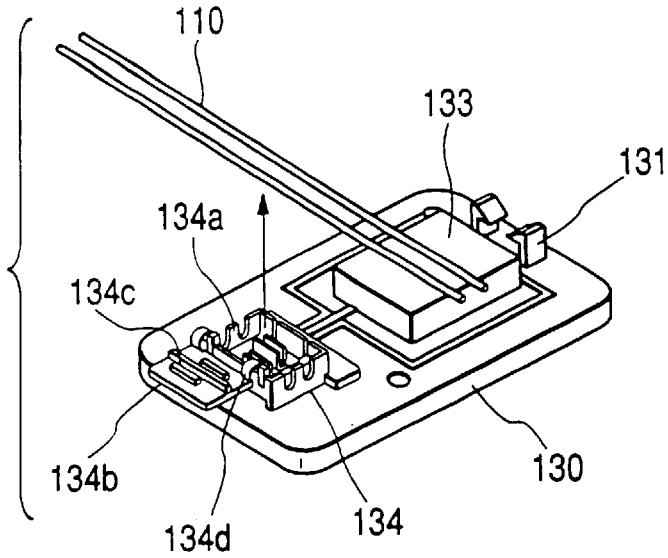
FIGS. 3A to 3C are diagrams showing a connection step in which the electric wire and an electric wire connecting portion of the electrically equipped part are connected to each other in the above embodiment.
Figure 3B:
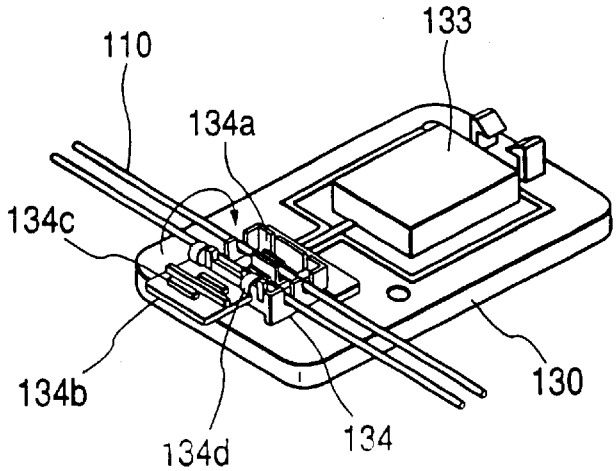
Figure 3C:
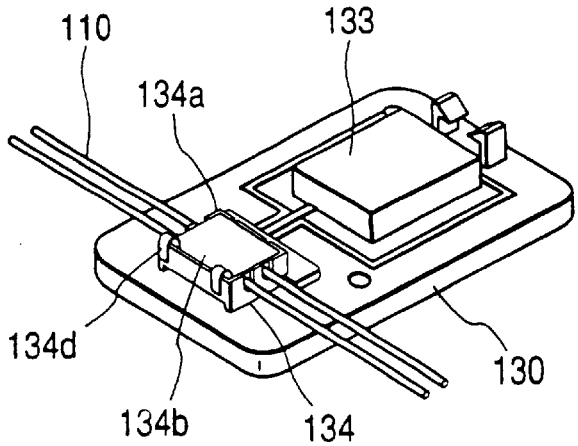

Next, a step of connecting the electric wire 110 and the electric connecting portion 134 will be described with reference to FIG. 3. In FIG. 3, an illustration of the interior member 120 is omitted. First, as shown in FIG. 3A, the function portion 133 and electric wire connecting portion 134 of the electrically equipped part 130 are inserted into the opening 121 from the room side (outside) of the interior member 120, and the pawls 131 are fitted in the fitting holes 122. As shown in FIG. 3B, at the substantially same time that the electrically equipped part 130 is temporarily fixed to the interior member 120, the electric wires 110 provided on the non-room side (inside) of the interior member 120 are positioned above the contact housing portion 134 of the electric wire connecting portion 134. Further, as shown in FIG. 3C, when the hinge 134*d* is bent in the opposite direction to fit the cover 134*b* to the contact housing portion 134*a,* while the state shown in FIG. 3B changes to the state shown in FIG. 3C, the insulated coating 110*b* of the electric wire 110 is broken as shown in FIG. 2 and the core wire 110*a* comes into contact with the contact member 136, so that the electric wires 110 are electrically connected to the electric wire connecting portion 134.

Namely, according to this embodiment, a simple operation that the electrically equipped part 130 is installed in the interior member 120 and the cover 134*b* of the electric wire connecting portion 134 is closed makes it possible to assemble the interior unit and to electrically connect the electric wire 110 to the electrically equipped part 130. Further, the electrically equipped part 130 is inserted into the interior member 120 from the room side (outside) thereby to fit the pawls 131 in the fitting holes 122, and the electric wires 110 provided on the non-room side (inside) of the interior member 120 are firmly fixed to the electric wire connecting portion 134. Therefore, for example, even in case that the finished interior unit is transported to an automotive assembly factory, possibility that the electrically equipped part 130 slips off from the interior member 120 becomes very low. As a result, a screw or an adhesive for fixing the electrically equipped part 130 to the interior member 120 is not required.

(Second Embodiment)

Figure 4:
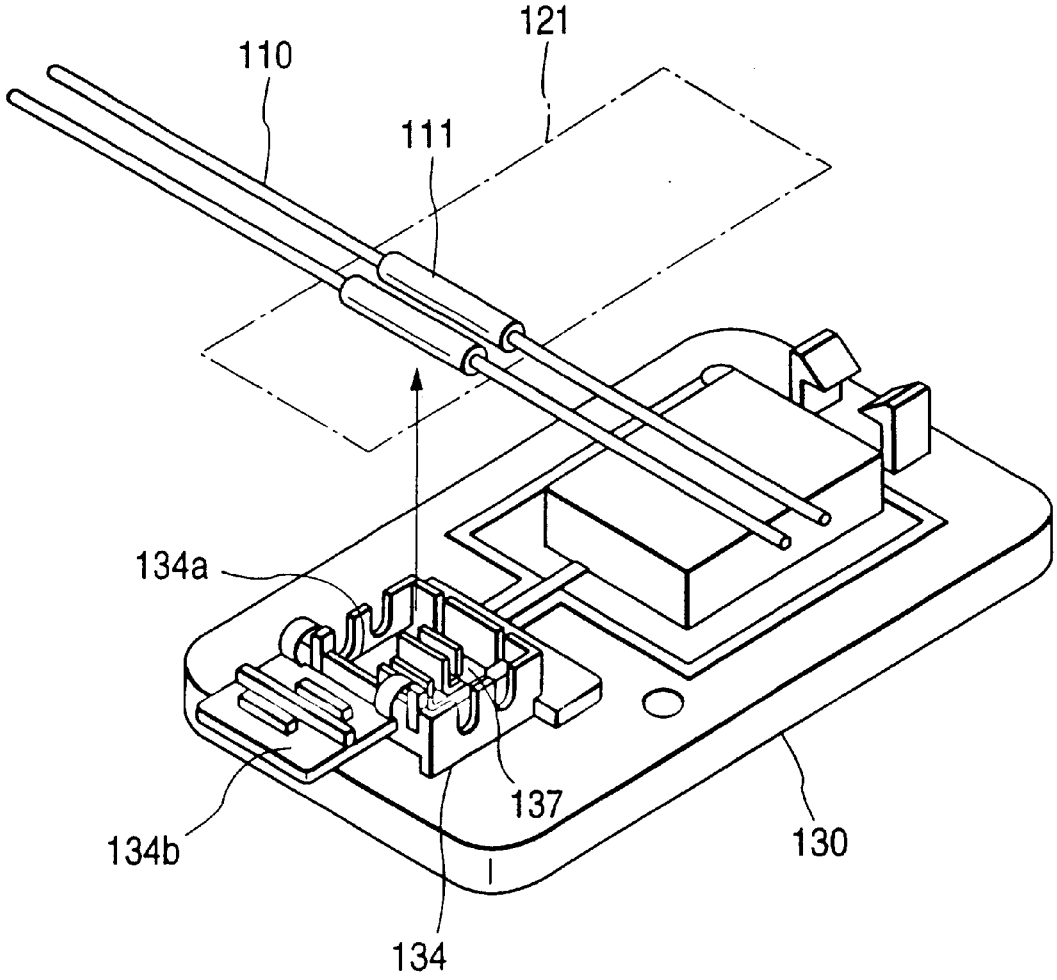
FIG. 4 is a diagram showing the constitution of a modified example of the above embodiment.
Figure 5:
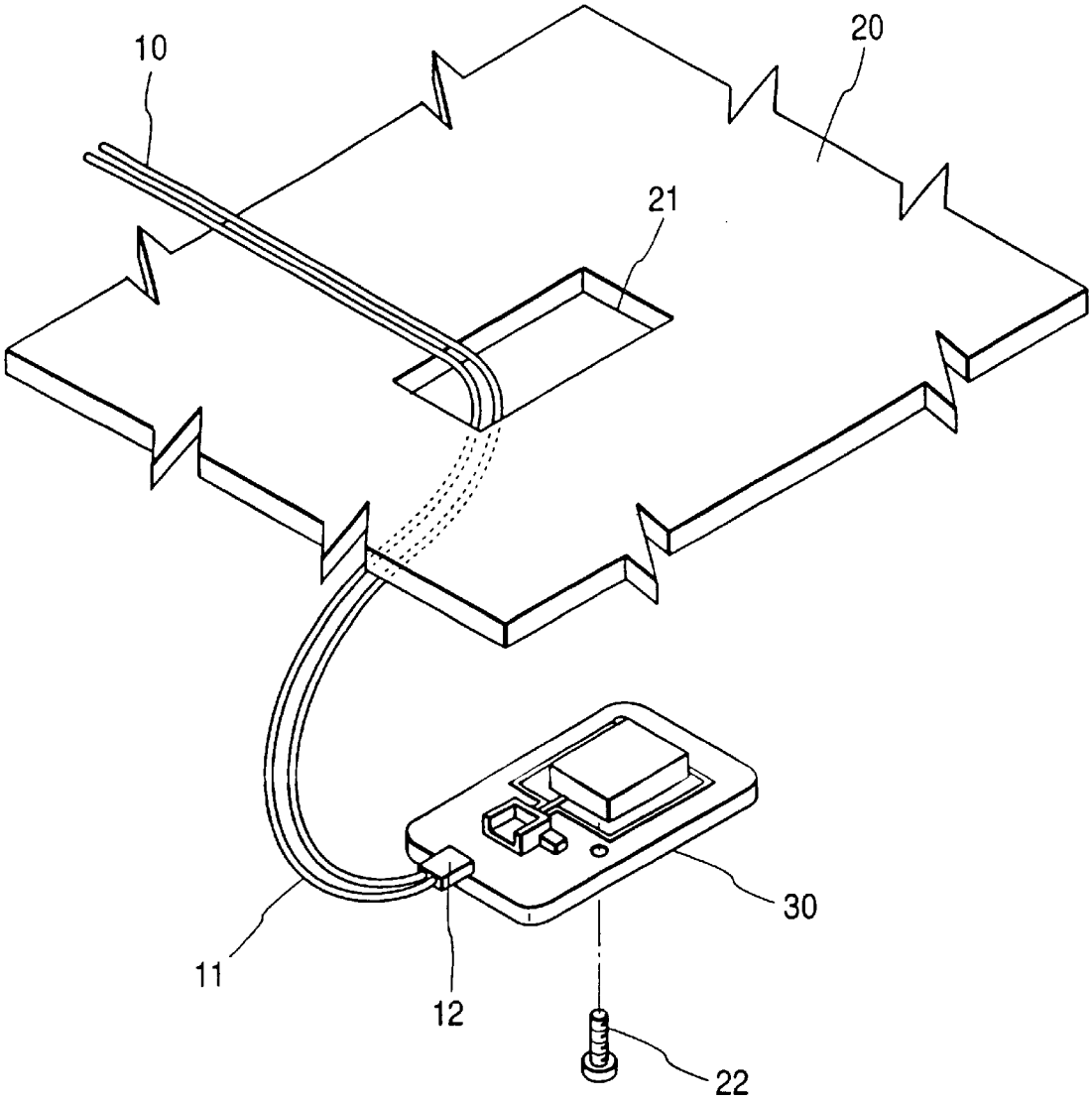
FIG. 5 PRIOR ART
FIG. 5 is a diagram showing an example of the conventional incorporating structure of an automotive interior member and an electrically equipped part.

In this embodiment, the insulated coating electric wire is used as the electric wire 110 and the insulated coating is broken when the electric wire 110 is pressed against the contact member 136. However, the invention is not limited to this. For example, as shown in FIG. 4, a contact member (first contact member) 111 may be attached to a portion of the electric wire 110 crossing the opening 121 of the interior member 120 by pressing or calking. In this case, as a contact member (second contact member) 137 provided for the electric wire connecting portion 134 of the electrically equipped part 130, a member formed in the shape of a flat plate or a leaf spring is used.

According to the structure of this modified example, though the contact member 111 must be previously attached to the electric wire 110, the shape of the contact member 137 on the electrically equipped part 130 side is simplified, and it is not necessary to break the insulated coating when the electric wire 110 is pressed against the electric wire connecting portion 134, so that small pressure makes it possible to connect the electric wire 110 to the electrically equipped part 130. Further, by fitting the cover 134*b* to the contact housing portion 134*a,* the electrical connection state of the electrical wire 110 and the electrically equipped part 130 can be stably held.

Further, in the above embodiment, the interior unit for the room ceiling has been described as the automotive interior unit, however, the invention is not limited to this. Namely, the automotive interior unit may be a door trim portion to which electrically equipped parts such as a power window switch, a foot lamp and the like are attached; or an instrument panel portion to which electrically equipped parts such as an audio device, a switch of an air conditioner and the like are attached. Further, the electrically equipped part 130 is not limited to a member such as a room lamp, a map lamp, or the like, which is operated from the room side; but it may be a member such as a temperature sensor of an air conditioner, which is not operated by a passenger.

Further, in the above embodiment, the electric wire 110 is previously laid on the non-room side (inside) of the interior room 120 and then the electrically equipped part 130 is inserted into the opening 121 from the room side (outside). However, the invention is not limited to this. Namely, before the electric wire 110 is laid, the electrically equipped part 130 may be inserted into the opening 121.

As described above, the electrically equipped part for automobile according to the invention comprises a base portion attached to an opening formed in an automotive interior member from a room side; an electric wire connecting portion, which is provided for the base portion so as to protrude from the opening to a non-room side of the interior member in a state where the base portion is fitted in the opening, and which can be connected to electric wires laid on the non-room side of the interior member; and a function portion, which is provided for the base portion, connected to the electric wire connecting portion through a conductor, and performs the predetermined function. Therefore, by using this electrically equipped part, the interior unit in which the electrically equipped part has been attached to the interior member and wiring has been provided can be readily assembled.

Further, by connecting the electric wire connecting portion to a halfway portion of the electric wire, assembly in case that plural electrically equipped parts are connected to a power supply line in parallel is facilitated.

Further, the electric wire laid on the non-room side of the interior member is an insulated coating wire; and the electric wire connecting portion is provided so as to substantially intersect in the arrangement direction of the electric wires, and includes a contact member that breaks the insulated coating of the electric wire and comes into contact with a conductive portion of the electric wire. Therefore, without peeling off the coating of the electric wire, the electric wire can be readily connected to the electrically equipped part.

Further, the electric wire connecting portion has lock mechanism that presses the electric wire against the contact member side and keeps the contact state between the contact member and the conductor. Therefore, once the electric wire is connected to the electrically equipped part, the connection is not readily cut, so that possibility of occurrence of the unsatisfactory connection can be reduced.

Further, a first contact member is attached to the electric wire laid on the non-room side of the interior member, and a second contact member connected to the first contact member is attached to the electric wire connecting section, whereby the comparatively small force enables the electric wire and the electrically equipped part to connect to each other.

Further, the electric wire connecting portion has lock mechanism that presses the first contact member against the second contact member side and keeps the contact state between the first contact member and the second contact member. Therefore, once the electric wire is connected to the electrically equipped part, the connection is not readily cut, so that possibility of occurrence of the unsatisfactory connection can be reduced.

Further, a fitting portion fitted in the interior member is provided for the base portion, whereby when the electric wire is connected to the electrically equipped part, the electrically equipped part can be temporarily fixed to the interior member, so that the work of connecting the electric wire and the electrically equipped part is facilitated.

Further, the automotive interior unit of the invention comprises an interior member that has an opening for attaching an electrically equipped part thereto and is fixed to a frame of an automobile; and an electrically equipped part of which at least a part is fitted in the opening from a room side, and which includes an electric wire connecting portion that can be electrically connected to electric wires laid so as to cross the opening. Therefore, the interior unit can be assembled and examined in a position other than a main line of the automotive assembly.

Further, the electric wire is previously laid so as to cross the opening into which the electrically equipped part is inserted. Therefore, at the substantially same time that the electrically equipped part is inserted into the opening, the electric wire is positioned in the predetermined position on the electrically equipped part, so that the work of connecting the electric wire and the electrically equipped part is facilitated.

Further, even if the electrically equipped part is pulled from the room side of the interior member, the electric wire crossing the opening provided on the non-room side functions as a slip-off preventing member, so that the electrically equipped part is prevented from slipping off from the interior member. Therefore, the interior unit to which the electrically equipped part is attached can be handled in a comparatively rough manner, similarly with the single interior member.

Further, the electric wire laid on the non-room side of the interior member is an insulated coating wire; and the electric wire connecting portion is provided so as to substantially intersect in the arrangement direction of the electric wires, and includes a contact member that breaks the insulated coating of the electric wire and comes into contact with a conductive portion of the electric wire. Hereby, only by pressing the electric wire against the electric wire connecting portion, breaking of the insulated coating of the electric wire and the electrical connection of the conductive portion and the contact member can be simultaneously performed. As a result, the work of peeling off the insulated coating of the electric wire is not required, whereby the assembling step of the interior unit can be simplified and the cost can be reduced.

Further, the electric wire connecting portion has lock mechanism that presses the electric wire against the contact member side and keeps the contact state between the contact member and the conductor. Hereby, by a simple operation that the electrically equipped part is attached to the interior member and a part of the electric wire connecting portion is actuated (for example, the cover is closed), the interior unit can be assembled, and the electrical connection of the electric wire and the electrically equipped part can be performed. Further, the electrical connection of the electric wire and the electrically equipped part can be stably performed.

Further, a first contact member is attached to the electric wire laid on the non-room side of the interior member, and the second contact member connected to the first contact member is attached to the electric wire connecting portion. Hereby, without peeling off the insulated coating of the electric wire, the comparatively small force enables the electric wire and the electrically equipped part to electrically connect to each other.

Further, the electric wire connecting portion has lock mechanism that presses the first contact member against the second contact member side and keeps the contact state between the first contact member and the second contact member, whereby the electrical connection of the electric wire and the electrically equipped part can be stably performed.

On the other hand, according to the assembling method of the automotive interior unit of the invention, electric wires are laid on an interior member that has an opening into which an electrically equipped part is inserted and that is fixed to a frame of an automobile so as to cross the opening on a non-room side of the interior member; a portion including at least an electric wire connecting portion of the electrically equipped part is inserted into the opening; and the electric wire connecting portion is electrically connected to the portion of the electric wire crossing the opening. Or, in relation to the interior member that has an opening into which the electrically equipped part is inserted and that is fixed to the frame of the automobile, the portion including at least the electric wire connecting portion of the electrically equipped part is inserted into the opening from the room side of the interior member; and the electric wires are laid on a non-room side so as to electrically connect to the electric wire connecting portion. Therefore, the interior unit can be assembled very readily without using the screw or the adhesive.

(Third Embodiment)

Figure 6:
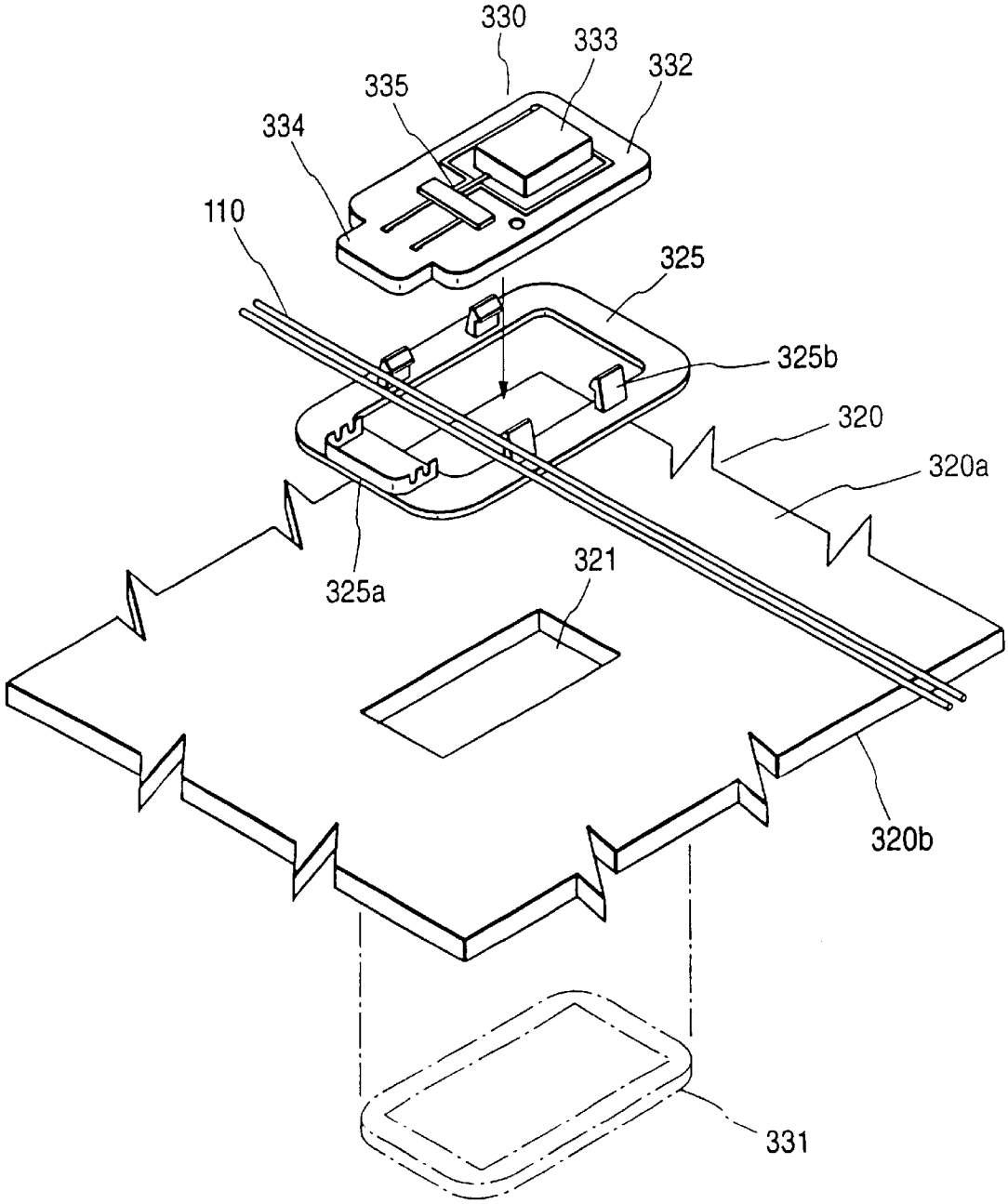
FIG. 6 is a diagram showing the constitution of one embodiment of an automotive interior unit of the invention.

Third embodiment of an electrically equipped part for automobile, an automotive interior unit, and its assembling method according to the invention will be described. FIG. 6 shows the structure of an electrically equipped part for automobile and an automotive interior unit using its part in this embodiment. As one example of the interior unit, an interior unit for a car room ceiling to which an electrically equipped part such as a room lamp, a map lamp, and the like is attached will be described.

In an interior member 320, there is provided an opening 321 for causing an electrically equipped part 330 such as a room lamp, a map lamp, and the like to function on a room side or enables it to be operated from the room side. Further, on a non-room side (inside) 320*a* of the interior member 320, an electrically equipped part holding member 325 is fixed with an adhesive or a both-sided adhesive tape so as to surround the opening 321. In the electrically equipped part holding member 325, there are formed an electric wire holding portion 325*a* for holding electric wires 110 and pawls 325*b* in which the electrically equipped part 330 is fitted and held. The electric wires 110 are laid on the non-room side so as to be held by the electric wire holding portion 325*a*. The electric wire 110 may be exclusive for only the electrically equipped part 130 in order to transmit the electric power and the predetermined signal, or it may be a bus line to which a plurality of the electrically equipped parts are connected in parallel. In case of the latter, the electrically equipped part 330 is connected to the halfway portion of the electric wire 110.

The electrically equipped part 330 comprises a cover member 331 inserted into the opening 321 of the interior member 320 from a room side (outside) 320*b;* a flange portion (base portion) 332 that is attached to the electrically equipped part holding member 325 from the non-room side 320*a* and fits in the pawls 325*a;* a function portion 333 such as a light bulb, a switch, and the like; an electric wire connecting portion 334 electrically connected to the electric wires 110; and a conductor 335 connecting the function portion 333 and the electric wire connecting portion 334 to each other. The electric wire connecting 334 has a recess portion that fits in the electric wire holding portion 325*a* of the electrically equipped part holding member 325, and within the electric wire connecting portion 334, a contact member (pressure welding terminal) 136 formed, for example, in the shape as shown in FIG. 2 is housed and held. The cover member 331, when the interior unit has been assembled, must not be always attached to the interior member 320. That is, in a main line of an automobile assembly, after the interior unit has been incorporated into the car body, the cover member may be attached to the opening 321 of the interior member 320.

FIG. 2A shows a state before the electric wires 110 are relatively forced into the contact member 136, and FIG. 2B shows a state after they has been forced. In fact, the contact member 136 moves to the electric wire 110 side. As shown in FIGS. 2A and 2B, the contact member 136 has plural sets (for example, two sets) of pressure welding blades 136*a* that protrude in the direction substantially orthogonal to the longitudinal direction of the electric wire 110 so as to be opposed to each other. Further, as the electric wire 110, an insulated coating electric wire coated with the insulating resin is used. When the pressure-welding blades 136*a* are pressed against the electric wire 110, the insulated coating 110 on the surface of the electric wire is broken by the pressure-welding blades 136*a,* and simultaneously, a core wire (conductor) 110*a* is held between the pressures welding blades 136*a.* Hereby, the electric wire 110 is electrically connected to the contact member 136. Further, since the contact member 136 is connected through the conductor 335 to the function portion 333, the function portion 333 is electrically connected to the electric wire 110.

Figure 7A:
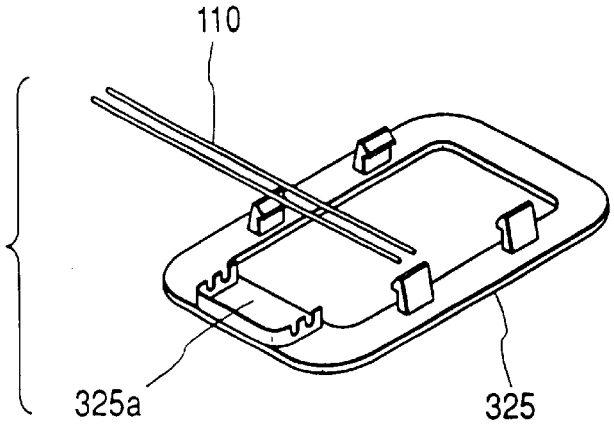
FIGS. 7A to 7C are diagrams showing a connection step in which the electric wire and an electric wire connecting portion of the electrically equipped part are connected to each other in the above embodiment.
Figure 7B:
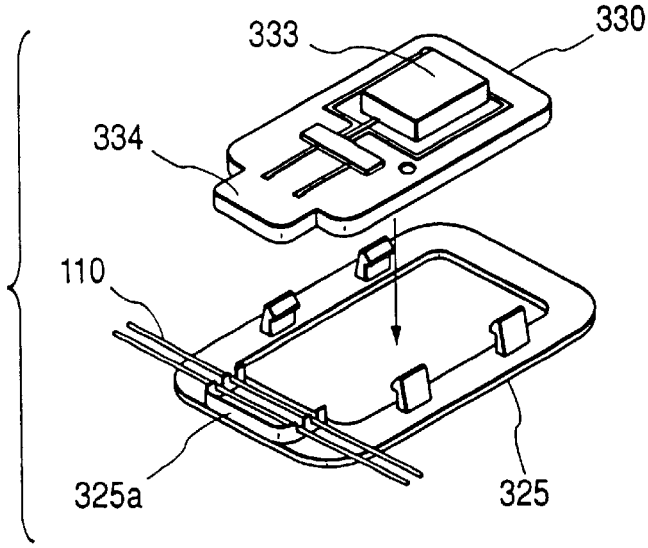
Figure 7C:
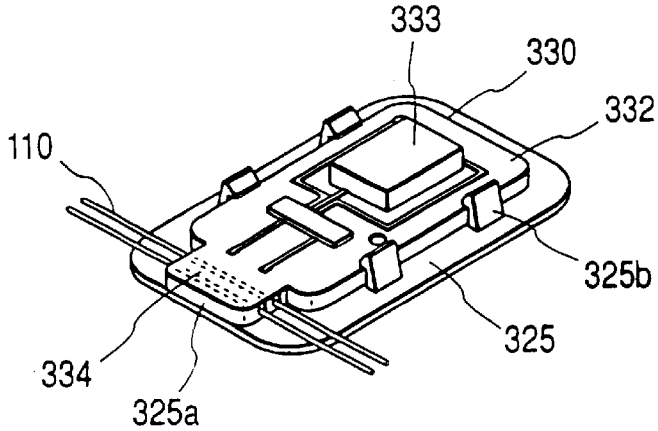

Next, a step of connecting the electric wire 110 and the electric connecting portion 334 in this embodiment will be described with reference to FIG. 7. In FIG. 7, an illustration of the interior member 320 is omitted. First, as shown in FIG. 7A, the electric wires 110 are placed on the electric wire holding portion 325*a* of the electrically equipped part holding member 325 provided on the room side (outside) of the interior member 320. As shown in FIG. 7B, when the electrically equipped part 330 is fitted in the electrically equipped part holding member 325 from the non-room side, the electric wires 110 are held between the electric wire holding portion 325*a* of the electrically equipped part holding member 325 and the electric wire connecting portion 334. Further, as shown in FIG. 7C, when the electrically equipped part 330 is completely fitted in the electrically equipped part holding member 325, while the state shown in FIG. 7B changes to the state shown in FIG. 7C, the insulated coating 110*b* of the electric wire 110 is broken as shown in FIG. 2 and the core wire 110*a* comes into contact with the contact member 136, so that the electric wires 110 are electrically connected to the electric wire connecting portion 334. At this time, the flange portion 332 of the electrically equipped part 330 fits in the pawls 325*b* of the electrically equipped part holding member 325, and the flange portion 332 is difficult to strip off on the non-room side. Therefore, by fitting the flange portion 332 in the pawls 325*b,* the pawls function as lock mechanism for keeping the contact state between the contact member 136 and the electric wire 110.

Namely, according to this embodiment, a simple operation that the electrically equipped part 330 is fitted in the electrically equipped part holding member 325 attached to the interior member 320 makes it possible to assemble the interior unit and to electrically connect the electric wire 110 to the electrically equipped part 330.

(Fourth Embodiment)

Figure 8:
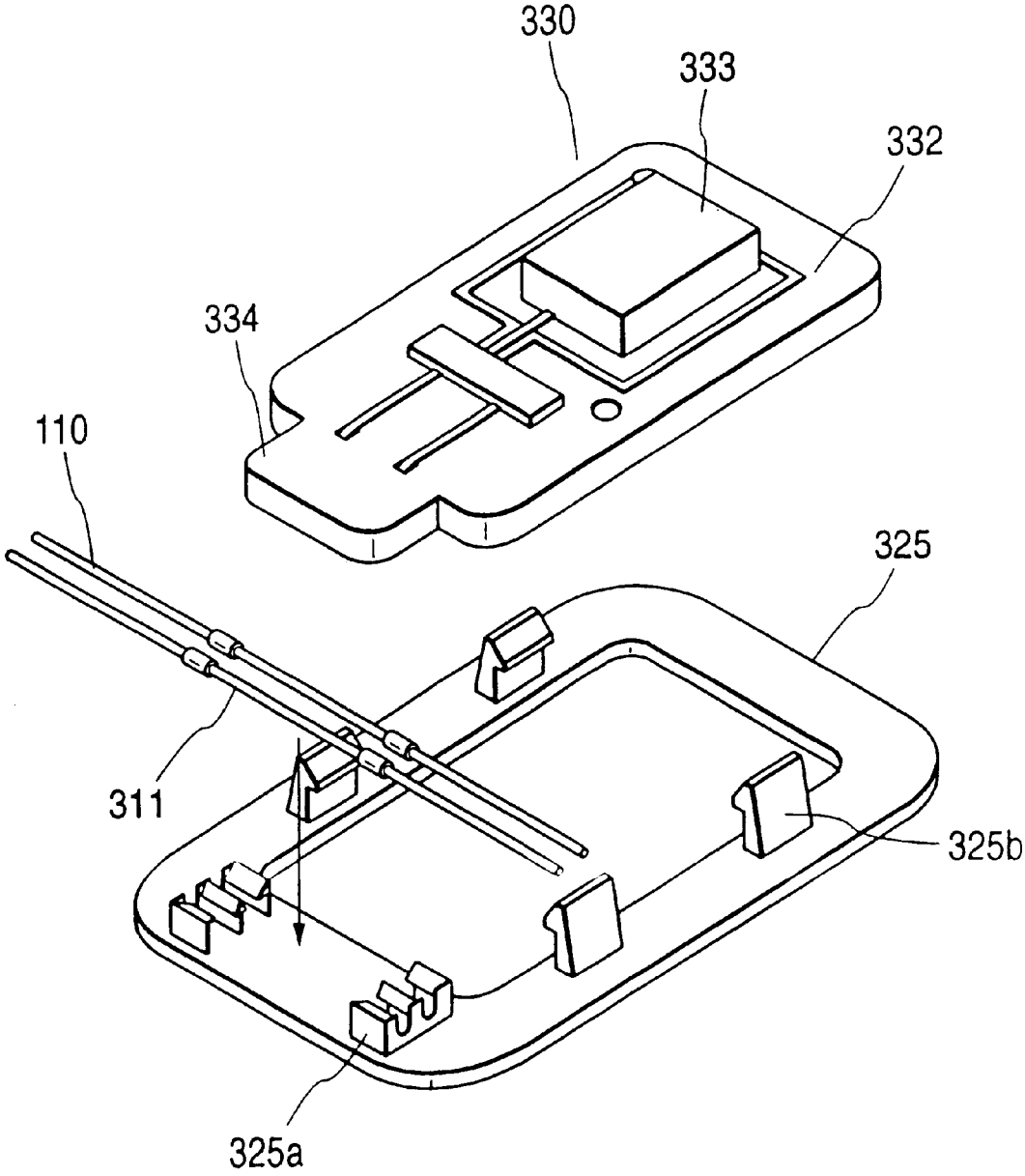
FIG. 8 is a diagram showing the constitution of a modified example of the above embodiment.

In this embodiment, the insulated coating electric wire is used as the electric wire 110 and the insulated coating is broken when the electric wire 110 is pressed against the contact member 136. However, the invention is not limited to this. For example, as shown in FIG. 8, contact members (first contact members) 311 may be attached to portions of the electric wire 110 connected to the electrically equipped part 330 by pressing or calking. In this case, as a contact member (second contact member: not shown) provided for the electric wire connecting portion 334 of the electrically equipped part 330, a member formed in the shape of a flat plate or a leaf spring can be used.

According to the structure of this modified example, though the contact member 311 must be previously attached to the electric wire 110, the shape of the contact member 337 on the electrically equipped part 330 side is simplified, and it is not necessary to break the insulated coating when the electric wire connecting portion 334 is pressed against the electric wire 110, so that small pressure makes it possible to connect the electric wire 110 to the electrically equipped part 330.

Further, in the above embodiment, the interior unit for the room ceiling has been described as the automotive interior unit, however, the invention is not limited to this. Namely, the automotive interior unit may be a door trim portion to which electrically equipped parts such as a power window switch, a foot lamp and the like are attached; or an instrument panel portion to which electrically equipped parts such as an audio device, a switch of an air conditioner and the like are attached. Further, the electrically equipped part 330 is not limited to a member such as a room lamp, a map lamp, or the like, which is operated from the room side; but it may be a member such as a temperature sensor of an air conditioner, which is not operated by a passenger.

Further, in the above embodiment, the electrically equipped part holding member 325 is formed separately from the interior member 320, and fixed with the adhesive or the both-sided adhesive tape. However, the invention is not limited to this. Namely, it may be formed integrally with the interior member 320.

As described above, the electrically equipped part for automobile according to the invention comprises an electrically equipped part body having a base portion that is attached in the vicinity of an opening formed in an automotive interior member from a non-room side in such a manner that a part thereof is exposed from the opening to a room side, an electric wire connecting portion, which is provided for the base portion and can be connected to electric wires laid on the non-room side of the interior member, and a function portion, which is provided for the base portion, connected to the electric wire connecting portion through a conductor, and performs the predetermined function; and an electrically equipped part holding member, which is formed separately from the base portion in order to fit and hold the base portion in the interior member, attached in the vicinity of the opening of the interior member, and has an electric wire holding portion for laying and holding the electric wire. Further, the electrically equipped part body is held in the electrically equipped part holding member thereby to connect the electric wire connecting portion to the electric wire held in the electric wire holding portion. Therefore, when the electrically equipped part is attached to the interior member, the electric wire is held between the electrically equipped part and the interior member and connected to the electrically equipped part substantially automatically, so that the connector connecting work between the electrical wire and the electrically equipped part can be omitted, and the assembly of the interior unit in which the electrically equipped part has been attached to the interior member and the wiring has been provided is facilitated.

Further, by connecting the electric wire connecting portion to a halfway portion of the electric wire, the assembly is facilitated in case that the plural electrically equipped parts are connected to a power supply line in parallel.

Further, the electric wire is an insulated coating wire; and the electric wire connecting portion is provided so as to substantially intersect in the arrangement direction of the electric wires held in the electric wire holding portion, and includes a contact member that breaks the insulated coating of the electric wire and comes into contact with a conductive portion of the electric wire. Hereby, without peeling off the coating of the electric wire, the electric wire can be readily connected to the electrically equipped part.

Further, a first contact member is attached to a portion of the electric wire connected to the electrically equipped part, and that a second contact member connected to the first contact member is attached to the electric wire connecting section. Hereby, the comparatively small force enables the electric wire and the electrically equipped part to connect to each other.

Further, the automotive interior unit of the invention comprises an interior member that has an opening and is fixed to a frame of an automobile; an electrically equipped part holding portion that is provided on a non-room side of the interior member and in the vicinity of the opening; an electric wire holding portion that is provided on the non-room side of the interior member and in the vicinity of said electrically equipped part holding portion; an electrically equipped part, which is held in the electrically equipped part holding portion so as to protrude partially from the opening to the room side, and which has an electric wire connecting portion connected electrically to electric wires held in the electric wire holding portion in the holding state. Therefore, the interior unit can be assembled and examined in a position other than a main line of the automotive assembly.

Further, the electric wires are provided in the vicinity of the electrically equipped part holding portion. Therefore, at the substantially same time that the electrically equipped part is inserted into the electrically equipped part holding portion, the electric wire is positioned in the predetermined position in relation to the electrically equipped part, so that the work of connecting the electric wire and the electrically equipped part is facilitated.

Further, the electric wire is an insulated coating wire, and the electric wire connecting portion is provided so as to substantially intersect in the arrangement direction of the electric wires, and includes a contact member that breaks the insulated coating of the electric wire and comes into contact with a conductive portion of the electric wire. Hereby, only by pressing the electrically equipped part against the electric wire, breaking of the insulated coating of the electric wire and the electrical connection of the conductive portion and the contact member can be simultaneously performed. As a result, the work of peeling off the insulated coating of the electric wire is not required, whereby the assembling step of the interior unit can be simplified and the cost can be reduced.

Further, the electrically equipped part is fitted and held in the electrically equipped part holding portion, whereby the electrically equipped part holding portion functions as lock mechanism that presses said contact portion against the electric wire side and keeps the contact state between the contact member and the conductor. Therefore, by a simple operation that the electrically equipped part is fitted in the electrically equipped part holding portion attached to the interior member, the interior unit can be assembled, and the electrical connection of the electric wire and the electrically equipped part can be performed. Further, the electrical connection of the electric wire and the electrically equipped part can be stably performed.

Further, a first contact member is attached to a portion of the electric wire connected to the electrically quipped part, and a second contact member connected to the first contact member is attached to the electric wire connecting portion. Hereby, without peeling off the insulated coating of the electric wire, the comparatively small force enables the electric wire and the electrically equipped part to electrically connect to each other.

Further, the electrically equipped part is fitted and held in the electrically equipped part holding portion, whereby the electrically equipped part holding portion functions as lock mechanism that presses the first contact member against the second contact member side and keeps the contact state between the first contact member and the second contact member. Hereby, the electrical connection of the electric wire and the electrically equipped part can be stably performed.

Further, the electrically equipped part holding portion serves as an electrically equipped part holding member that is formed separately from the base portion and attached in the vicinity of the opening of the interior member, and the electric wire holding portion is provided for this electrically equipped part holding member. Hereby, regardless of material or shape of the interior member, the electrically equipped part can be attached to the various interior members.

Further, the electrically equipped part holding portion and the electric wire holding portion are formed in the vicinity of the opening integrally with the interior member. Hereby, the number of the parts can be reduced, the manufacturing steps can be simplified, and the cost can be reduced.

On the other hand, according to an assembling method of an automotive interior unit of the invention, in relation to an interior member that has an opening into which an electrically equipped part is inserted and an electrically equipped part holding portion provided in the vicinity of the opening, and that is fixed to a frame of an automobile; electric wires are laid on a non-room side of the interior member and in the vicinity of the electrically equipped part holding portion, and the electrically equipped part is fitted in the electrically equipped part holding member from the non-room side, thereby to electrically connect an electrical wire connecting portion of the electrically equipped part to the electric wires. Therefore, the interior unit can be assembled very readily.

What is claimed is:

1. An automotive interior unit, comprising:

an interior member that has an opening and is fixed to a frame of an automobile;

an electrically equipped part holding portion that is provided on a non-room side of said interior member and in a vicinity of said opening;

an electric wire holding portion that is provided on the non-room side of said interior member and in a vicinity of said electrically equipped part holding portion; and an electrically equipped part, which is held in said electrically equipped part holding portion so as to be exposed partially from said opening to a room side, and which has an electric wire connecting portion connected electrically to electric wires held in said electric wire holding portion in a holding state.

2. The automotive interior unit according to claim 1, wherein:

said electric wires are an insulated coating wires, and said electric wire connecting portion is provided so as to substantially intersect in an arrangement direction of said electric wires, and includes a contact member that breaks the insulated coating of said electric wires and comes into contact with a conductive portion of said electric wires.

3. The automotive interior unit according to claim 2, wherein:

said electrically equipped part is fitted and held in said electrically equipped part holding portion so that the electrically equipped part holding portion functions as lock mechanism that presses said contact member against said electric wire side and keeps the contact state between said contact member and said conductive portion.

4. The automotive interior unit according to claim 1, wherein:

the electrically equipped holding portion is formed separately from the interior member and attached in the vicinity of the opening; and the electric wire holding portion is provided on the electrically equipped holding portion.

5. The automotive interior unit according to claim 1, wherein:

the electrically equipped part holding portion and the electric wire holding portion are formed in the vicinity of the opening integrally with the interior member.

6. An assembling method of an automotive interior unit, in which in relation to an interior member that has an opening in which an electrically equipped part is inserted and an electrically equipped part holding portion provided in a vicinity of said opening, and that is fixed to a frame of an automobile;

said assembling method comprising:

laying electric wires on an electrical wire holding portion on a non-room side of said interior member and in a vicinity of said electrically equipped part holding portion;

fitting said electrically equipped part in said electrically equipped part holding portion from the non-roomside; and electrically connecting an electrical wire connecting portion of said electrically equipped part to said electric wires.

7. An assembling method of an automotive interior unit, said automotive interior unit having an interior member that has an opening in which an electrically equipped part is inserted and an electrically equipped part holding portion provided in a vicinity of said opening, and that is fixed to a frame of an automobile;

said assembling method comprising steps of:

laying electric wires on an electrical wire holding portion on a non-room side of said interior member and in a vicinity of said electrically equipped part holding portion;

fitting said electrically equipped part in said electrically equipped part holding portion from the non-room side, said electrically equipped part holding portion being separate from said interior member; and electrically connecting an electrical wire connecting portion of said electrically equipped part to said electric wires.

* * * * *